US006309194B1

(12) United States Patent
Fraser et al.

(10) Patent No.: US 6,309,194 B1
(45) Date of Patent: Oct. 30, 2001

(54) ENHANCED OIL FILM DILATION FOR COMPRESSOR SUCTION VALVE STRESS REDUCTION

(75) Inventors: Bruce A. Fraser, Manlius; Peter F. Kaido, Verona; Michael J. Dormer, Fabius; Wayne P. Beagle, Chittenango; Kyle D. Wessells, Syracuse, all of NY (US); Foster P. Lamm, South Windsor, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 08/868,790

(22) Filed: Jun. 4, 1997

(51) Int. Cl.[7] ..... F04B 39/10

(52) U.S. Cl. ..... 417/569; 137/246; 137/856; 251/355

(58) Field of Search ..... 417/432, 433, 417/569, 571; 137/246, 856, 246.12, 246.13; 251/355

(56) References Cited

U.S. PATENT DOCUMENTS

| | | | | |
|---|---|---|---|---|
| 1,583,535 | * | 5/1926 | Dubrovin | 417/433 |
| 1,834,038 | | 12/1931 | Summers . | |
| 2,001,885 | | 5/1935 | Ohmart . | |
| 2,020,508 | | 11/1935 | Knapp . | |
| 2,110,107 | | 3/1938 | Drysdale . | |
| 2,372,938 | | 4/1945 | Doeg . | |
| 2,981,462 | | 4/1961 | NieDemayer . | |
| 4,406,590 | | 9/1983 | Kessler . | |
| 4,444,219 | * | 4/1984 | Hollenstein | 137/246 |
| 4,522,568 | | 6/1985 | Gelse et al. . | |
| 4,580,604 | * | 4/1986 | Kawaguchi et al. | 137/856 |
| 4,628,963 | | 12/1986 | Ishijima et al. | 137/857 |
| 4,642,037 | * | 2/1987 | Fritchman | 417/571 |
| 4,955,797 | | 9/1990 | Cowen . | |
| 5,035,050 | | 7/1991 | Cowen . | |
| 5,062,779 | | 11/1991 | Da Costa . | |
| 5,192,200 | * | 3/1993 | Lilie et al. | 417/571 |
| 5,203,686 | | 4/1993 | Scheldorf et al. . | |
| 5,452,994 | | 9/1995 | Erickson | 417/550 |
| 5,476,371 | * | 12/1995 | Dreiman | 417/550 |
| 5,609,476 | | 3/1997 | Kim et al. | 417/447 |
| 5,806,336 | * | 9/1998 | Sunaga et al. | 417/415 |
| 5,884,665 | * | 3/1999 | Thurston et al. | 137/856 |

FOREIGN PATENT DOCUMENTS

| | | | |
|---|---|---|---|
| 0 231 955 A2 | 5/1984 | (EP) | 137/856 |
| 60-7371 | 1/1985 | (JP) | 137/856 |
| 60-7372 | 1/1985 | (JP) | 137/856 |
| 2-26713 | 6/1990 | (JP) | 137/856 |
| 2-61631 | 12/1990 | (JP) . | |

* cited by examiner

*Primary Examiner*—Cheryl J. Tyler

(57) ABSTRACT

The seat of a suction valve of a reciprocating compressor is modified to limit the area in which an annular oil film can be established between the valve and the valve seat. The seat is configured to limit the oil film from 3% to 33% of the total inlet port opening. In a modified embodiment gas at discharge pressure exerts an opening bias to the suction valve at the end of the discharge stroke.

6 Claims, 4 Drawing Sheets

ENHANCED OIL FILM DILATION FOR COMPRESSOR SUCTION VALVE STRESS REDUCTION

BACKGROUND OF THE INVENTION

In positive displacement compressors employing suction and discharge valves there are both similarities and differences between the two types of valves. Normally the valves would be of the same general type. Each valve would be normally closed and would open due to a pressure differential across the valve in the direction of opening. The valve may be of a spring material and provide its own seating bias or separate springs may be employed. Since the suction valve(s) open into the compression chamber/cylinder they generally do not have valve backers in order to minimize the clearance volume and thus deflection of the valve is not physically limited. Discharge valves normally have some sort of valve backer so as to avoid excess movement/flexure of the discharge valve. Ignoring the effects of the clearance volume, leakage, etc., an equal mass of gas is drawn into the compression chamber and discharged therefrom. However, the suction stroke takes place over, nominally, a half cycle whereas the compression and discharge stroke together make up, nominally, a half cycle. In the case of the suction stroke, the suction valve opens as soon as the pressure differential across the suction valve can cause it to unseat. Typically, the pressure differential required to open the suction valve is on the order of 15–35% of the nominal suction pressure. In the case of the compression stroke, compression continues with the attendant reduction in volume/increase in density of the gas being compressed until the pressure of the compressed gas is sufficient to overcome the combined system pressure acting on the discharge valve together with spring bias of the valve member and/or separate springs. Typically, the pressure differential required to open the discharge valve is on the order of 20–40% of the nominal discharge pressure. Accordingly, the mass flow rate is much greater during the discharge stroke.

By design, suction valves have a much lower seating bias than discharge valves. The low seating bias is essential due to the fact that valve actuation is initiated by the force resulting from the pressure differential across the valve. In the case of suction valves, opening generally occurs at pressures that are much lower than for discharge valves. Therefore, only small pressure differences, and hence small opening forces, can be created relative to potential pressure differences and opening forces for discharge valves. Even a small increase in the pressure differential across the suction valve results in a large percentage increase in the pressure differential across the valve. In contrast, an equal increase in the pressure differential across the discharge valve results in a much smaller percentage increase in the pressure differential because of the substantially higher nominal operating pressure.

The opening force, F, on a valve is given by the equation $$F=P\cdot A$$

where P is the pressure differential across the valve and A is the valve area upon which P acts. It should be noted that the direction in which the pressure differential acts changes during a complete cycle so that during a portion of a cycle the pressure differential provides a valve seating bias. When A is held constant, it is clear that a change in F is proportional to a change in P, or, more specifically, the percentage change in F is proportional to the percentage change in P. For example, assuming an operating condition where suction pressure is 20 psia and discharge pressure is 300 psia, at a typical overpressure value of 35% the cylinder will rise to 405 psia before the discharge valve opens. In contrast, at a typical underpressure value of 30%, the cylinder pressure will drop to 14 psia, before the suction valve opens. If the pressure differential required to open both valves is increased by 10 psia, the discharge overpressure value increases to 38% from 35% while the suction underpressure value increases to 80% from 30%. Thus, we can expect the opening force on the suction valve to increase 167%.

Particularly because of the effects of the clearance volume, the change in pressure differential across the suction valve would not increase very rapidly since the device is initially charged due to the compressed gas from the clearance volume and is then acting as a vacuum pump until the suction valve opens. Specifically, the inflow of gas to the cylinder is typically designed to occur during the last 95% of the combined expansion and suction stroke. In contrast, the compression chamber pressure rises rapidly as the compression stroke is being completed and the pressure can continue to rise during the discharge stroke if the volume flow exiting the cylinder does not match the rate of reduction in the compression chamber volume. Typically, the outflow of gas from the cylinder occurs during the last 40% of the combined compression and discharge stroke. Any substantial change in one or more of these relationships can result in operational problems relative to the valves.

Another complicating factor arises from the fact that under typical operating conditions, lubricating fluid (oil) coats all internal surfaces of a compressor, including the suction and discharge valves and valve seats. The associated problems as to improving discharge efficiency as related to the discharge valve have been addressed in U.S. Pat. No. 4,580,604. In the case of a discharge valve, the cylinder pressure must overcome the system pressure acting on the discharge valve, the spring bias on the valve an any adhesion of the valve to the seat. Accordingly, the adhesion of the discharge valve to the seat represents an over pressure and therefore an efficiency loss.

SUMMARY OF THE INVENTION

A typical reciprocating compressor will have a valve plate with an integral suction port and suction valve seat. When in the closed position, the film of oil present between the suction valve and its seat is very thin, on the order of a few molecular diameters. This is in part due to the fact that compression chamber pressure acts on and provides a seating bias for the suction valve. In normal operation, the opening force applied to the suction valve is provided by a pressure differential across the valve that is created as the piston moves away from the valve during the suction stroke. Typically, the opening force needs to be large enough to overcome the resistance to opening caused by valve mass (inertia) and any spring or other biasing forces. The force also needs to be substantial enough to dilate and shear the oil film trapped between the valve and seat. Factors that influence the force necessary to dilate and shear the lubricant film include: the viscosity of the lubricant film, the thickness of the oil film, the inter-molecular attractive forces between the lubricant molecules, the materials of construction of the suction valve and/or valve seat, and the rate of refrigerant outgassing.

In traditional refrigerant-compressor applications using mineral-based (MO) or alkylbenzene (AB) lubricants, the resistance to opening caused by the lubricants is negligible as indicated by the relatively small pressure differential that is required to initiate valve opening. This is due, in large part, to the fact that MO and AB lubricants exhibit relatively low viscosity, low inter-molecular forces and good solubility with refrigerants over the entire range of operating conditions.

Newer, ozone-friendly refrigerant-compressor applications utilize polyol ester (POE) lubricants. When compared to MO or AB lubricants, POE lubricants can exhibit extremely high lubricant viscosity and poor solubility with HFC refrigerants such as R134A, R404A, and R507, particularly under low operating pressures and/or temperatures. The relatively high viscosity of POE's can cause a substantial increase in the force necessary to dilate and shear the oil film trapped between the valve and seat. Additionally, POE lubricants are very polar materials and hence have a strong molecular attraction to the polar, iron-based materials that are typically used to manufacture valves and valve seats. The mutual attraction of the materials of construction and the POE further increases the force necessary to separate the valve from the valve seat.

In order to generate the increase in force needed to separate the suction valve from its valve seat, the pressure differential across the valve must be increased with an accompanying delay in the valve opening time. When the suction valve does finally open, it does so at a very high velocity. Further, aggravating this condition is the increase in the volume flow rate of the suction gas entering the cylinder resulting from the delay in the suction valve opening. The increase in the volume flow rate of the suction gas causes an increase in suction gas velocity which, in turn, increases the opening force applied to the suction valve and, hence, the velocity at which the valve opens. The increased suction valve opening velocity resulting from the combined effects of a higher pressure differential on the valve due to the delayed opening and the higher volumetric flow rate of the flow impinging upon the suction valve causes the suction valve to deflect further than intended into the cylinder bore. Without the benefit of a valve backer, as would be present in a discharge valve, valve operating stress must increase as a result of the increase in valve deflection. If the operating stress exceeds the apparent fatigue strength of the valve, then valve failure will occur.

The present invention reduces the pressure force required to open the suction valve by promoting dilation of the oil film trapped between the suction valve and the valve seat. In this fashion, subsequent problems associated with high valve velocity, high volume flow rate, high suction gas velocity, and high valve stress are avoided. In effect, by reducing the contact area between the valve and the valve seat, a beneficial reduction in the pressure force required to open the valve can be attained, along with a subsequent reduction in operating stress.

Experimentation has shown that it is critical to maintain the ratio of valve seat area to valve port area in the range of 3% to 33% with a physical dimension of 0.003 inches being a lower limiting value. The valve seat area is considered to be the area of actual contact plus the area where the members are so close that an oil film exists between them. Accordingly, a line contact between a flat valve member and a rounded seat would be considered to have an area due to the presence of the oil film adjacent the line contact. The minimum value is necessary to provide sufficient sealing area thereby maintaining compression efficiency by preventing gas leakage past the suction valve during the compression stroke. The lower bound of the seat area/port area ratio is also necessary to prevent excessive wear at the valve/seat interface. A maximum force per unit area is in this way established at the valve seat for the range of operating conditions expected for a typical compressor. The upper bound of the seat width/port area ratio is required to limit the contact area of the valve/seat interface. Again, experimentation has revealed that for ratios in excess of 33%, the pressure force required to open the valve results in a valve velocity and subsequent stress that exceeds the apparent fatigue strength of the valve material. Thus, valve failure can result from ratios in excess of the upper bound value for seat area/port area ratio.

Edge geometry of both the inside and outside diameters has a minimal effect on the pressure force required to open the valve. Said another way, it matters little whether the edge geometry consists of a rounded, chamfered or square shoulder. However, experimentation has shown that it is desirable to provide either a rounded or chamfered-edge geometry for both the inside and outside diameters of the valve seat. These particular geometric configurations tend to provide a larger effective contact area for the valve as it closes, thereby reducing the impact force per unit area and reducing wear at the valve/seat interface. Therefore, it is preferable to smooth the transition from the sealing (flat) surface by utilizing an edge radius or chamfer.

It is an object of this invention to reduce suction valve adhesion to the valve seat.

It is an additional object of this invention to reduce operating stress on a suction valve.

It is another object of this invention to facilitate opening of a suction valve. These objects, and others as will become apparent hereinafter, are accomplished by the present invention.

Basically, the valve seat of a suction valve is configured through rounding or chamfering to reduce the contact area and associated oil film between the valve and valve seat. In a modified embodiment, a fluid pocket is communicated with the compression chamber via a restricted passage such that compressed gas nominally at discharge pressure is in the fluid pocket at the start of the suction stroke and provides an opening bias to the valve.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
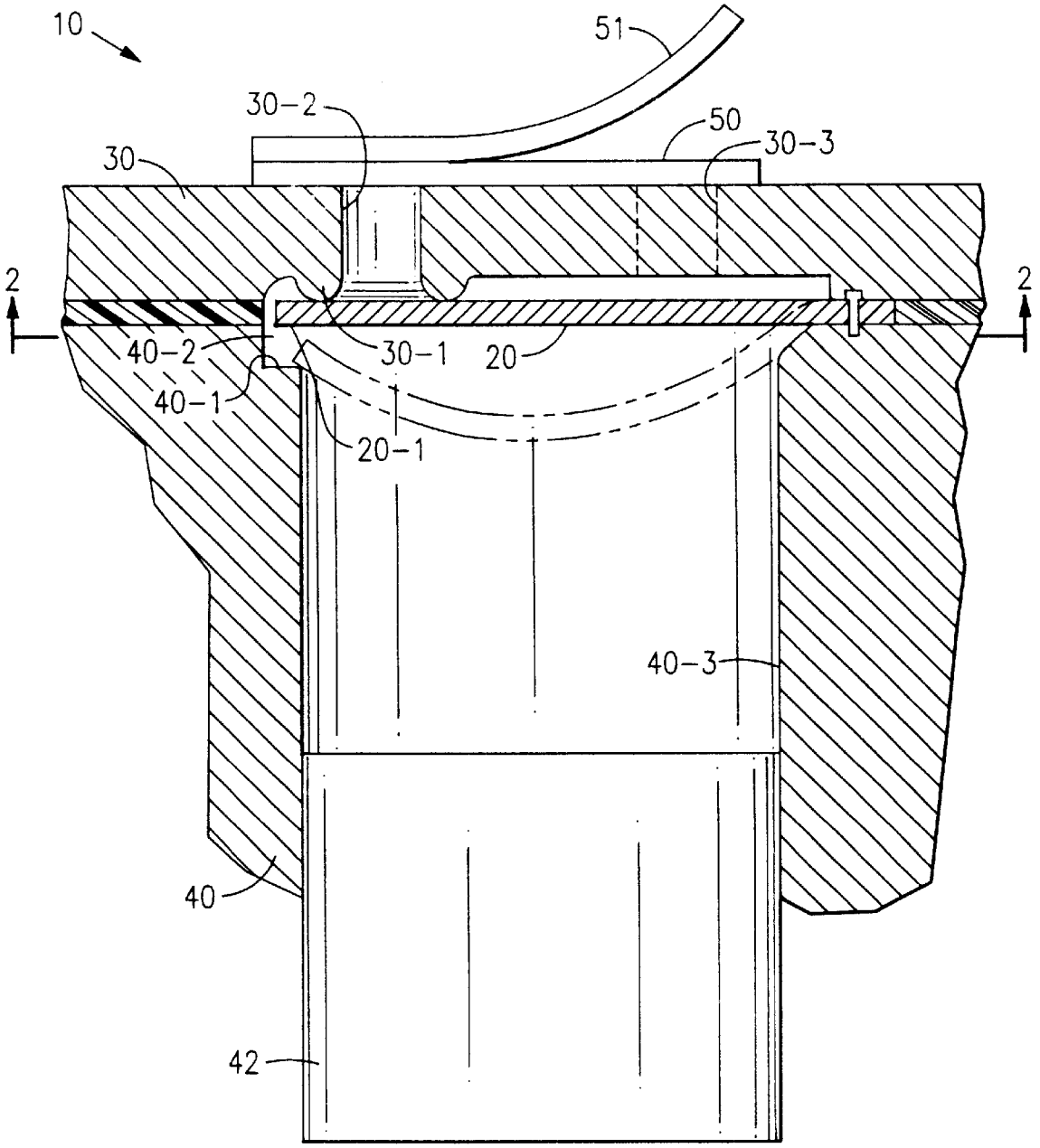
FIG. 1 is a sectional view of a portion of a reciprocating compressor employing the present invention.
Figure 2:
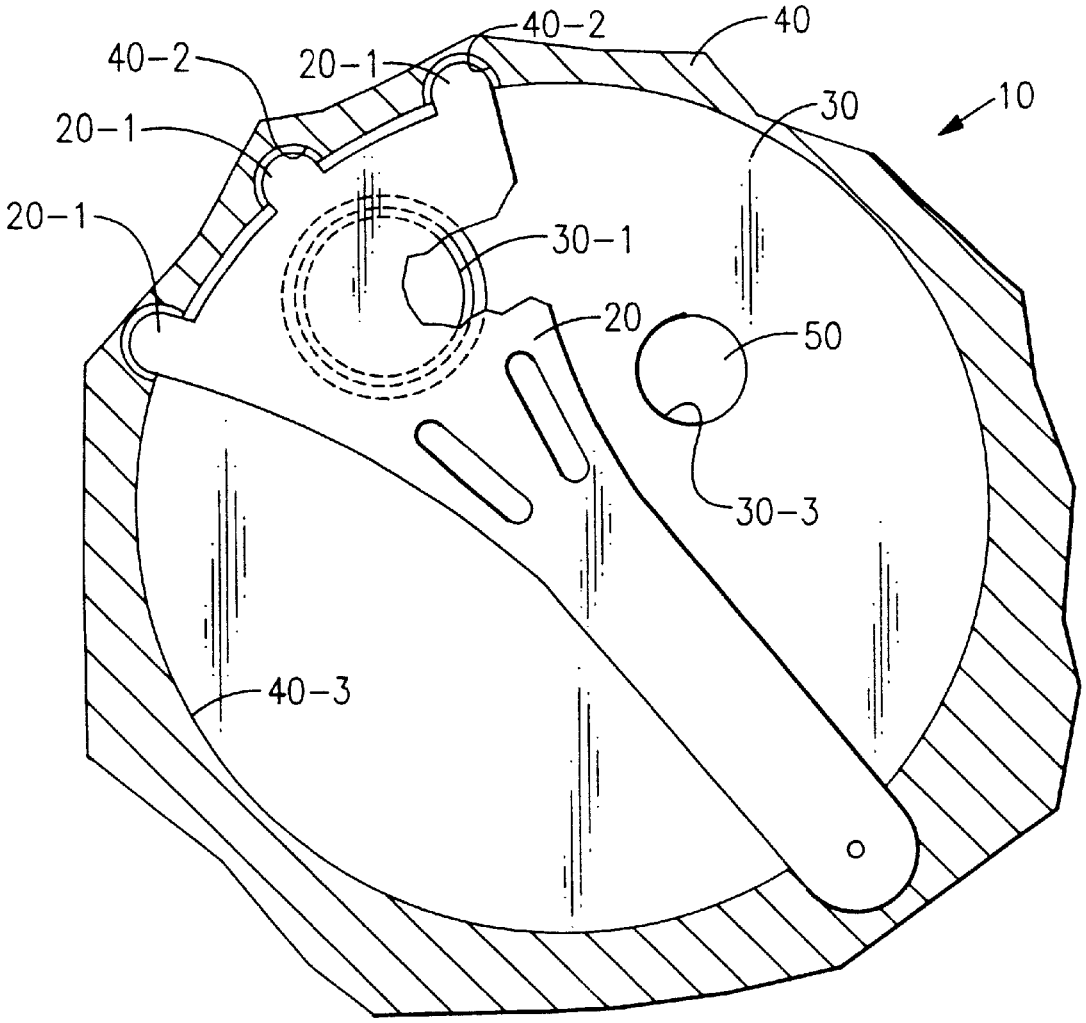
FIG. 2 is a partially cutaway view taken along section 2—2 of FIG. 1.

In FIGS. 1 and 2, the numeral 10 generally designates a reciprocating compressor. As, is conventional, compressor 10 has a suction valve 20 and a discharge valve 50, which are illustrated as reed valves, as well as a piston 42 which is located in bore 40-3. Discharge valve 50 has a backer 51 which limits the movement of valve 50 and is normally configured to dissipate the opening force applied to valve 50 over its entire opening movement away from discharge passage 30-3. In the case of suction valve 20, its tips 20-1 engage valve stops defined by ledges 40-1 in recesses 40-2 in crankcase 40. Ledges 40-1 are engaged after an opening movement on the order of 0.1 inches, in order to minimize the clearance volume, with further opening movement by flexure of valve 20 as shown in phantom in FIG. 1. Specifically, initial movement of valve 20 is as a cantilevered beam until tips 20-1 engage ledges 40-1 and then flexure is in the form of a beam supported at both ends. As shown in phantom in FIG. 1, valve 20 moves into bore 40-3.

As discussed above, the POE lubricants tend to cause adhesion between valve 20 and seat 30-1 formed in valve plate 30. Absent the adhesion reduction of the present invention, valve 20 would open at a higher differential pressure and tend to strike ledges or stops 40-1 at a higher velocity such as to facilitate flexure into bore 40-3 which, when coupled with the impinging flow from suction passage 30-2 can cause flexure of valve 20 beyond its yield strength and/or drive valve 20 so far into bore 40-3 that tips 20-1 slip off of ledge or stops 40-1.

Figure 3:
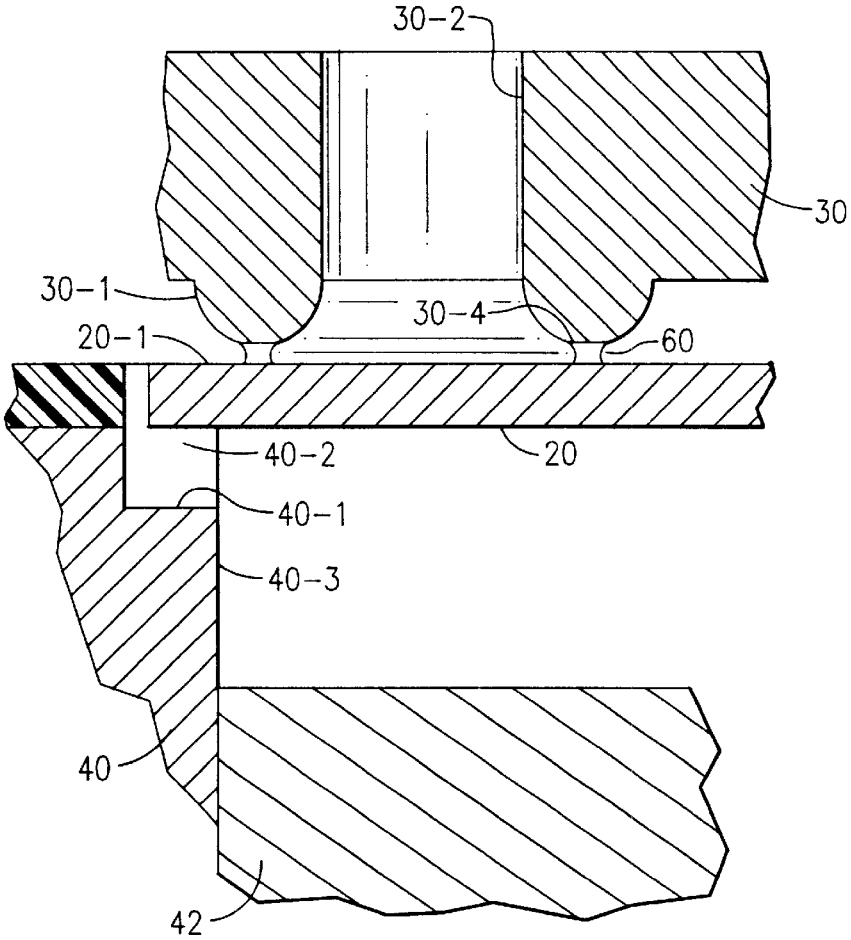
FIG. 3 is a sectional view of a portion of FIG. 1 showing the suction valve structure.

Turning now to FIG. 3, it will be noted that seat 30-1 is configured such that it is relieved in the area not making contact. As illustrated, seat 30-1 is of a spherical surface but it may have a small flattened area or have a trapezoidal cross section. The main consideration is to limit the location and thereby the width of oil film 60. Specifically, the portion of seat 30-1 touching or in close proximity with valve 20 so as to maintain an oil film 60 therebetween must be of a cross sectional area that is 3% to 33% of the area defined by the inside edge or boundary of the oil film 60 which point, 30-4, may correspond to the edge of a flat. The 3% to 33% ratio is the limits with the compromise between wear and force of adhesion placing the preferred range at 13% to 25%. As should be obvious, the smaller the oil film, the more easily it is ruptured with the consequence of opening earlier in the suction stroke at a lower differential pressure a less violent opening and slower flow.

Figure 4:
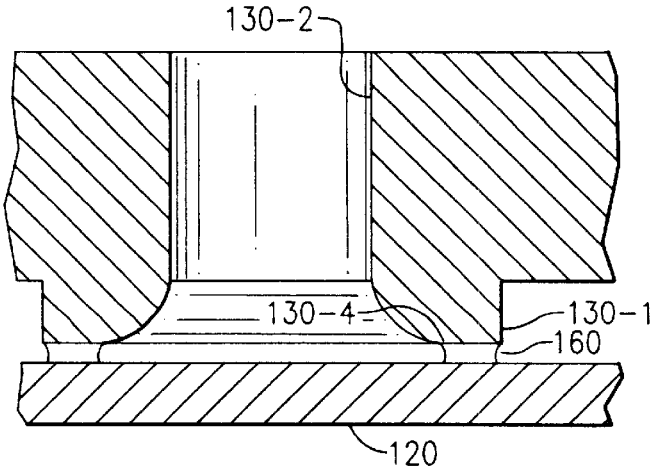
FIG. 4 is a sectional view of a first modified suction valve structure.

FIG. 4 shows a modified valve seat 130-1 which has a larger oil film since the curved portion of seat 130-1 only extends for 90° with a flat forming a portion of the seat. When the ratio of the area of oil film 160 to the area where suction passage 130-2 meets oil film 160, point 130-4, is within the 3% to 33% range valve 120 will operate as described above.

Figure 6:
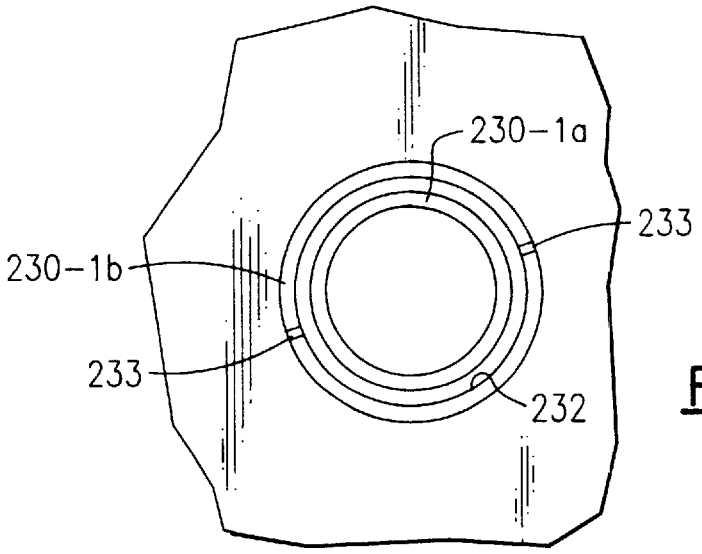
FIG. 6 is an axial view of the seating structure of FIG. 5.
Figure 5:
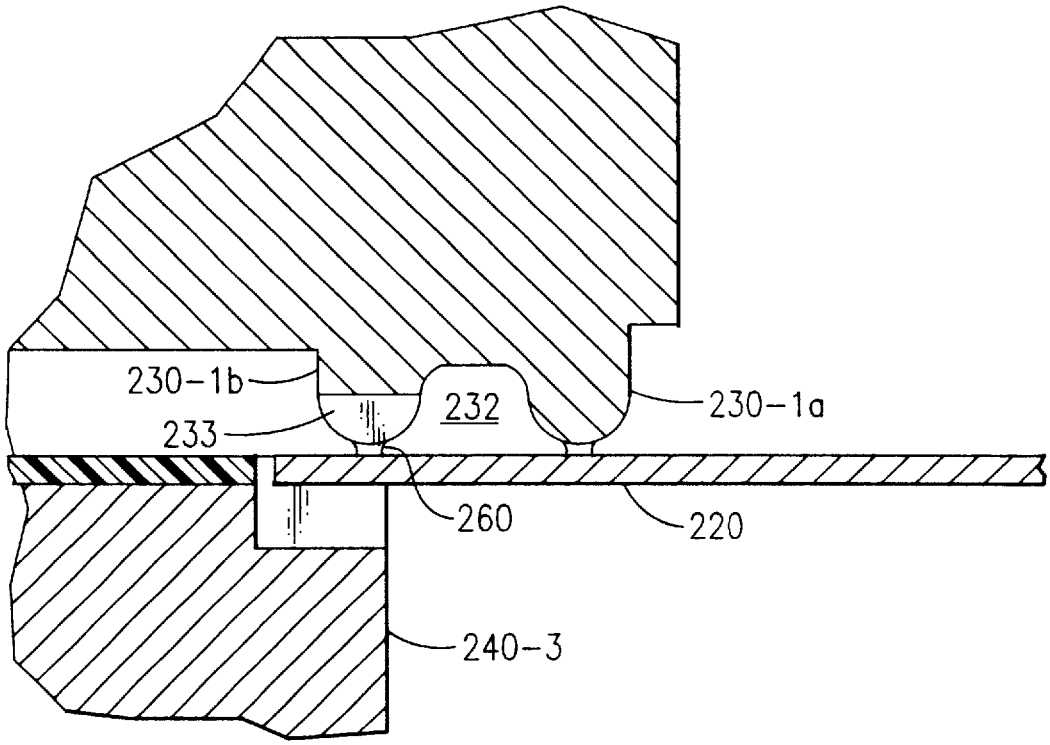
FIG. 5 is a sectional view of a second modified suction valve structure.

Referring now to FIGS. 5 and 6, it will be noted that the valve seat is in the form of two radially spaced annular seats 230-1*a* and 230-1*b*. An annular chamber 232 is thus formed by seats 230-1*a* and 230-1*b* and valve 220. Restricted communication between chamber 232 and bore 240-3 is possible during the compression stroke and discharge stroke via one or more radial passages 233. Radial passages 233 are sized such that they are not bridged/blocked by the oil film 26° but restrict flow at the transition between the discharge stroke and the suction stroke such that fluid pressure in chamber 232 acts on valve 220 to tend to cause it to unseat at the start of the suction stroke.

Although preferred embodiments of the present invention have been illustrated and described, other changes will occur to those skilled in the art. It is therefore intended that the scope of the present invention is to be limited only by the scope of the appended claims.

What is claimed is:

1. In a reciprocating compressor having a cylinder with a piston therein, a suction valve and a valve plate with an integral suction valve seat and lubricated by POE oil which forms an oil film between said suction valve and said valve seat with at least a portion of said oil film being no more than a few molecular diameters thick the improvement comprising:

said seat forming surrounding wall which is an extension of a suction passage and which reduces in cross sectional thickness in the direction of suction flow such that said wall has its minimal thickness at a location engaged by said valve;

said portion of said oil film formed between said seat and said valve has a maximum cross sectional area between 3% and 33% of the cross sectional area within said oil film, a second seat surrounding and radially spaced from said seat forming an extension of said suction passage such that when said valve is seated on said seat forming an extension of said suction passage and said second seat a chamber is formed therebetween; and fluid passage means formed in said second seat and providing restricted fluid communication between said cylinder and said annular chamber during a compression and a discharge stroke of said compressor whereby fluid pressure in said chamber provides an opening bias to said valve at the start of a suction stroke.

2. The improvement of claim 1 wherein HFC refrigerant is being compressed by said compressor.

3. The improvement of claim 2 wherein the HFC refrigerant is one of R134A, R404A and R507.

4. The improvement of claim 1 wherein at least one of said seats has a rounded surface which is engaged by said valve.

5. In a reciprocating compressor having a cylinder with a piston therein, a suction valve and a valve plate with an integral suction valve seat and lubricated by POE oil which forms an oil film between said suction valve and said valve seat the improvement comprising:

said seat forming a surrounding wall which is an extension of a suction passage and which reduces in cross sectional thickness in the direction of suction flow such that said wall has its minimal thickness at a location engaged by said valve;

a second seat surrounding and radially spaced from said seat forming an extension of said suction passage such that when said valve is seated on said seat forming an extension of said suction passage and said second seat a chamber is formed therebetween; and fluid passage means formed in said second seat and providing restricted fluid communication between said cylinder and said annular chamber during a compression and a discharge stroke of said compressor whereby fluid pressure in said chamber provides an opening bias to said valve at the start of a suction stroke.

6. The improvement of claim 5 wherein at least one of said seats has a rounded surface which is engaged by said valve.

* * * * *